US006641477B1

(12) United States Patent
Dietz, II

(10) Patent No.: US 6,641,477 B1
(45) **Date of Patent: *Nov. 4, 2003**

(54) ELECTRONIC SECOND SPIN SLOT MACHINE

(75) Inventor: Michael J. Dietz, II, Peralta, NM (US)

(73) Assignee: Infinity Group Inc., Albuquerque, NM (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/003,003

(22) Filed: Jan. 5, 1998

Related U.S. Application Data

(63) Continuation-in-part of application No. 08/571,743, filed on Dec. 13, 1995, now Pat. No. 5,704,835.

(51) Int. Cl.[7] ..... A63F 9/24
(52) U.S. Cl. ..... 463/20; 463/16; 273/143 R
(58) Field of Search ..... 463/20, 16, 13, 463/31; 273/143 R, 138 A, 85 CP

(56) References Cited

U.S. PATENT DOCUMENTS

| | | | | |
|---|---|---|---|---|
| 2,579,241 A | | 12/1951 | Nicolaus | |
| 4,200,291 A | | 4/1980 | Hooker | |
| 4,874,173 A | | 10/1989 | Kishishita | |
| 5,067,712 A | | 11/1991 | Georgilas | |
| 5,152,529 A | | 10/1992 | Okada | |
| 5,255,915 A | | 10/1993 | Miller | |
| 5,308,065 A | | 5/1994 | Bridgeman et al. | |
| 5,342,047 A | * | 8/1994 | Heidel et al. | 273/85 CP |
| 5,356,140 A | | 10/1994 | Dabrowski et al. | |
| 5,393,061 A | * | 2/1995 | Manship et al. | 273/143 R |
| 6,056,642 A | * | 5/2000 | Bennett | 463/20 |

FOREIGN PATENT DOCUMENTS

| | | |
|---|---|---|
| DE | 320-395 A | 12/1983 |
| EP | 58488 | 11/1982 |
| GB | 2083935 | 3/1982 |
| GB | 2092797 | 8/1982 |
| GB | 2097160 | 10/1982 |
| GB | 2098779 | 11/1982 |
| GB | 2106292 | 4/1983 |
| GB | 2106293 | 4/1983 |
| GB | 2106295 | 4/1983 |
| GB | 2109605 | 6/1983 |
| GB | 1153572 | 8/1985 |
| GB | 2170636 | 2/1986 |
| GB | 2182476 | 5/1987 |
| GB | 2190227 | 11/1987 |
| GB | 2226907 | 7/1988 |
| GB | 2243236 | 10/1991 |

OTHER PUBLICATIONS

Thunderbird Gaming, Inc., *Global Excellence* Catalog.
Betstar Ltd., Advertisement for Orbit and Spinning Wheels.
Bally Gaming V–5000 Plus.
Bally Bonus Draw Poker and Stars & Bars.
Eagle Co., Ltd., Sevenplus, Back to Fruits, Western Train, Golden Treasure, Pierrot Panic.

* cited by examiner

*Primary Examiner*—Jessica Harrison
*Assistant Examiner*—Carmen D. White
(74) *Attorney, Agent, or Firm*—Townsend and Townsend and Crew LLP; Guy W. Chambers

(57) ABSTRACT

An electronic slot machine (10) and method of use which allows a player to completely replace up to all of the initial symbols displayed after the first draw in order to create, improve or even lose a winning combination. In its preferred form, the electronic slot machine of the present invention features a video monitor (10) with a plurality of separate symbol display boxes (32) arrayed in rows and columns. When the machine is activated, one or more random numbers are generated in the slot machine's microprocessor (15) to determine which symbols are to be displayed in each of the symbol display boxes. If a suitable winning combination is not formed with the initial symbols, the player is given opportunities to select up to all of the symbol display boxes for replacement.

35 Claims, 5 Drawing Sheets

| | |
|---|---|
| seven | :1 |
| seven | :2 |
| seven | :3 |
| bar | :4 |
| orange | :5 |
| plum | :6 |
| cherry | :7 |
| bell | :8 |
| bar | :9 |
| cherry | :10 |
| orange | :11 |
| orange | :12 |
| bell | :13 |
| plum | :14 |
| orange | :15 |
| bell | :16 |
| seven | :17 |
| bell | :18 |
| plum | :19 |
| bell | :20 |
| orange | :21 |
| plum | :22 |
| bar | :23 |
| plum | :24 |
| seven | :25 |
| bell | :26 |
| plum | :27 |
| orange | :28 |
| bar | :29 |
| bell | :30 |
| cherry | :31 |
| plum | :32 |
| bar | :33 |
| bell | :34 |
| orange | :35 |
| orange | :36 |
| plum | :37 |
| plum | :38 |
| orange | :39 |
| bar | :40 |
| bell | :41 |
| seven | :42 |
| plum | :43 |
| orange | :44 |
| bar | :45 |
| plum | :46 |
| bell | :47 |
| plum | :48 |
| plum | :49 |
| bar | :50 |

*FIG. 4.*

ELECTRONIC SECOND SPIN SLOT MACHINE

This is a continuation-in-part of U.S. patent application Ser. No. 08/571,743, filed Dec. 13, 1995, which is now U.S. Pat. No. 5,704,835.

TECHNICAL FIELD OF THE INVENTION

The present invention relates to a type of gaming machine which is commonly referred to as a slot machine. More particularly, the present invention relates to an electronic slot machine which allows players to select for respin one or more of the symbols displayed after the machine's first spin. This feature allows the player to get a second chance at creating, improving or even losing a winning combination.

BACKGROUND OF THE INVENTION

Over the years, many games of chance have been devised to allow players to wager a sum of money and have the opportunity to win greater sums of money. Such games include lotteries, bingo, keno, blackjack, poker, roulette, craps and slot machines.

Of these games, many people find slot machines to be the most entertaining. In a basic mechanical slot machine, the player inserts a bill or coin and pulls down on the slot machine handle to initiate the game. Three parallel, rotatable reels with an assortment of fruit, number and/or bar symbols are then caused to spin until each reel reaches a resting position. The success or failure of the game is then determined by comparing the combination of reel symbols across a horizontal row with a table of winning combinations posted on the slot machine. To add interest to the game, the basic mechanical slot machine windows are frequently made large enough to show three adjacent symbols on each reel and thereby allow betting involving multiple rows. This betting can take the form, for example, of betting on the combinations formed across the upper horizontal row, middle horizontal row and lower horizontal row. Betting along diagonal lines intersecting these rows is also made possible. Because the combination of symbols on each reel of a basic mechanical slot machine is fixed, there is typically no betting on vertical column combinations in the basic mechanical slot machine.

With the advent of electronic technology, there have been many improvements to the basic slot machine. Among these improvements are the use of video monitors to display an imitation of three parallel, rotatable reels, rather than having three actual reels themselves. In operation, these electronic slot machines simulate the rotation of a physical reel, but typically select the final symbols through use of random numbers generated by a microprocessor rather than any physical rotation of a reel. In other words, the final symbols for each simulated reel in the electronic slot machine are randomly selected by the microprocessor and then displayed on the video monitor at the appropriate time and position.

The use of electronic technology for slot machines has allowed additional improvements to slot machine play. For example, the number of combinations that can be displayed on a video monitor is no longer limited by the number of symbols that can be fit onto three physical reels. This opportunity for greater numbers of displayed combinations has led the way to greater jackpots and progressive slot machines. Also, with electronic technology, the three symbols shown in each column no longer need to correspond to three adjacent symbols on a physical reel. Through generation of different random numbers, each symbol displayed in a video monitor column can be independently generated. By independently generating each of the symbols shown on the video monitor, betting along vertical columns as well as horizontal rows and diagonal lines has now become feasible.

One frequent frustration that players have with slot machines, even the new electronic slot machines, is that the combination which is finally displayed along their betting line may fall just short of a winning combination and the player has no opportunity for adjusting the displayed combination, short of completely starting a new game. To address this frustration, some mechanical slot machines allow a player to "nudge" one of the reels so that the displayed symbol is moved one notch and replaced by an adjacent symbol on the reel which is visible to the player. The success or failure of the game is then redetermined based upon the combination appearing after one of the reels has been "nudged."

While the "nudging" feature does help overcome some of the frustration of being one symbol short of a winning combination, it provides only limited relief. For example, if the next symbol on the particular reel will not create a winning combination, then there is no reason to "nudge" and have that next symbol included in the displayed combination. Also, to the extent the symbol to be nudged into place is visible, it is fairly obvious to the player whether or not to nudge. For this reason, use of a "nudging" feature adds very little additional interest to the game and, moreover, is unlikely to allow such slot machines to be reclassified from a game of "chance" to a game of "skill" in those jurisdictions which prohibit games of "chance."

SUMMARY OF THE INVENTION

The present invention provides an electronic slot machine which allows a player to completely respin one or more of the symbols displayed after the first spin in order to create, improve or even lose a winning combination. In its preferred form, the electronic slot machine of the present invention features a video monitor with a plurality of symbol display boxes arrayed in rows and columns. When the machine is activated through, for example, insertion of a valid coin and pressing of the "spin" button, one or more random numbers are generated in the slot machine's microprocessor and compared to one or more reel strips encoded in computer memory to determine which symbols are to be displayed in each of the symbol display boxes. If a desirable winning combination is not formed after this first spin, the player is given an opportunity to select one or more of the symbol display boxes, rows of symbol display boxes or columns of symbol display boxes for respin. Where a touchscreen is used in conjunction with the video monitor, the player can make this selection simply by touching the boxes, rows of boxes or columns of boxes to be respun. After an appropriate number of boxes are chosen for respin, one or more additional random numbers are generated and compared with reel strips encoded in the computer memory to determine which new symbols are to be displayed in each of the selected boxes. After the new symbols are displayed in the selected boxes, the microprocessor compares the displayed symbols with a memorized list of winning combinations to determine if the game is a winner. If a winning combination is formed, the microprocessor determines the appropriate payout for the winning combination and provides the player with that payout.

There are, of course, numerous respin options that are enabled by the apparatus of the present invention. For example, if a symbol after the first repin turns out to be the same as the original symbol, that symbol can be respun again, either automatically or at the player's option, in order to try to obtain a different symbol. Alternatively, having the same symbol appear again after a respin could be used as an opportunity for allowing the player to have a second chance to respin any of the other symbols. As a second alternative, color backgrounds could be added to each of the symbol boxes and serve as an additional criteria for respinning to achieve winning combinations.

BRIEF DESCRIPTION OF THE DRAWINGS

FIG. 4 illustrates a typical reel strip which can be encoded into the slot machine's computer memory.

DESCRIPTION OF THE SPECIFIC EMBODIMENTS

Figure 1:
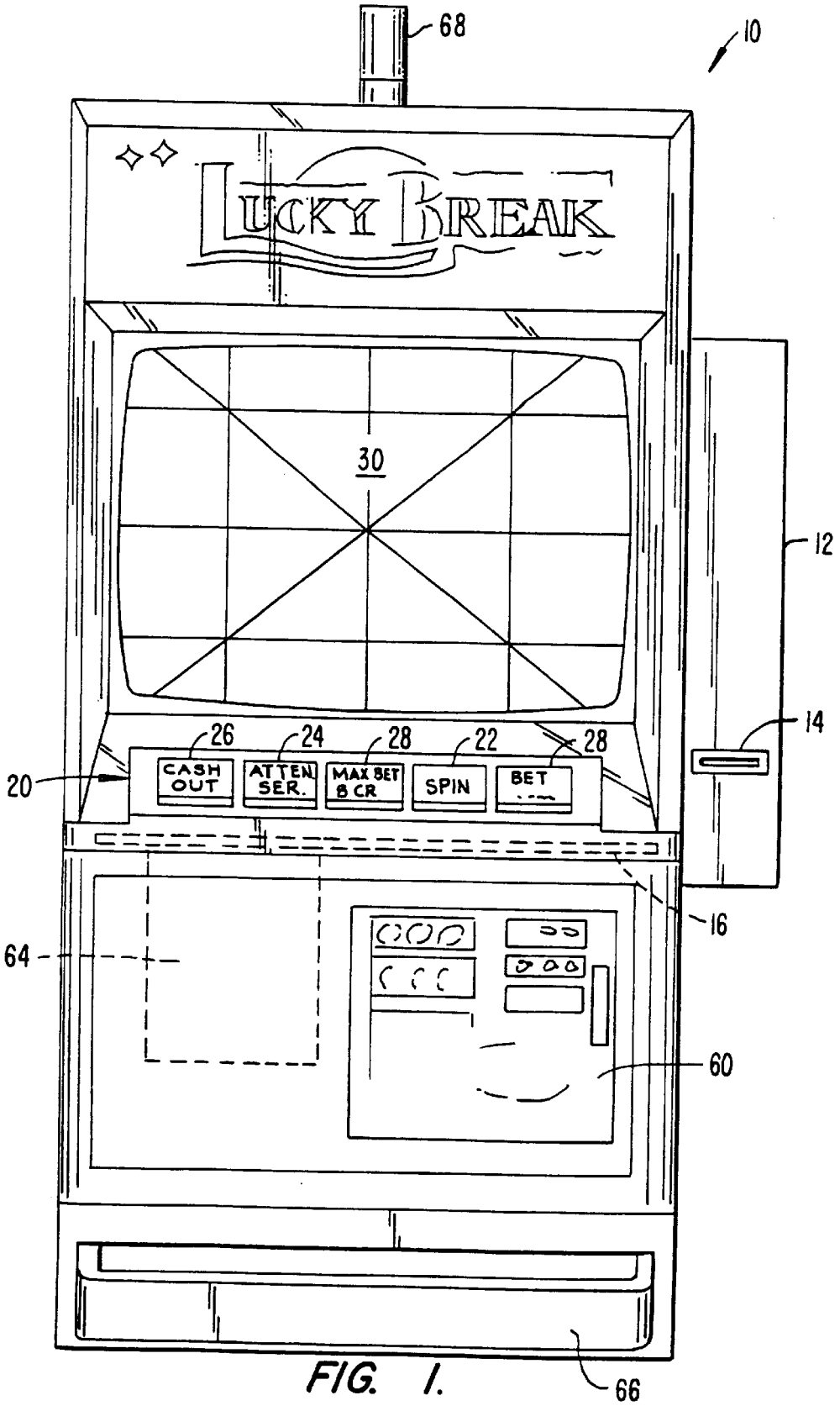
FIG. 1 shows a front view of a preferred form of electronic second spin slot machine of the present invention.

Referring now to FIG. 1, a preferred form of electronic second spin slot machine 10 of the present invention is shown. Like slot machines generally, this preferred form of second spin slot machine collects money, initiates game play, illustrates game play and provides a payout for successful game play. For this particular slot machine, a bill validator 12 is provided to accept money in slot 14 in the form of bills of various denominations. A suitable bill validator for the second spin slot machine 10 of the present invention is the DBV145 bill validator manufactured by JCM of Kanagawa and Osaka, Japan. The bill validator 12 pulls in the bills, determines the denomination of the bills and determines whether the bills are valid. If a bill is invalid, it will be returned to the player back through slot 14. To the extent valid bills are inserted into the bill validator 12, bill validator 12 will retain them and communicate their presence to the slot machine's microprocessor 15 (FIG. 3), which is located on computer motherboard 16. Alternatively, a coin acceptor 17 and hopper 18 (FIG. 3) could be used to collect coins, count them, validate them and store them. Again, the information about the amount and validity of coins ascertained by the coin acceptor 17 is communicated to the slot machine's microprocessor 15. As a second alternative, the bill validator 12 can be configured to accept credit cards issued by the casino, such as a SMARTCARD™, or by multinational corporations, such as VISA™ or AMERICAN EXPRESS™ cards.

If sufficient bills, coins or credits have been inserted into the slot machine 10, the slot machine's microprocessor 15 (FIG. 3) will allow game play to be initiated. In the preferred embodiment, a "spin" button 22 located on the slot machine's button panel 20 will be lit and enabled by the microprocessor 15. This "spin" button 22 serves as a switch to allow the player to initiate game play simply by pressing it. Additional buttons 24, 26, 28 are also located on the button panel 20 of the slot machine 10 to allow the player to call the attendant 24, cash out any accumulated winnings 26 or make multiple bets before initiating game play 28. These additional buttons 24, 26, 28 are also lit during game play, particularly when their functions are available for activation by the player.

Figure 2:
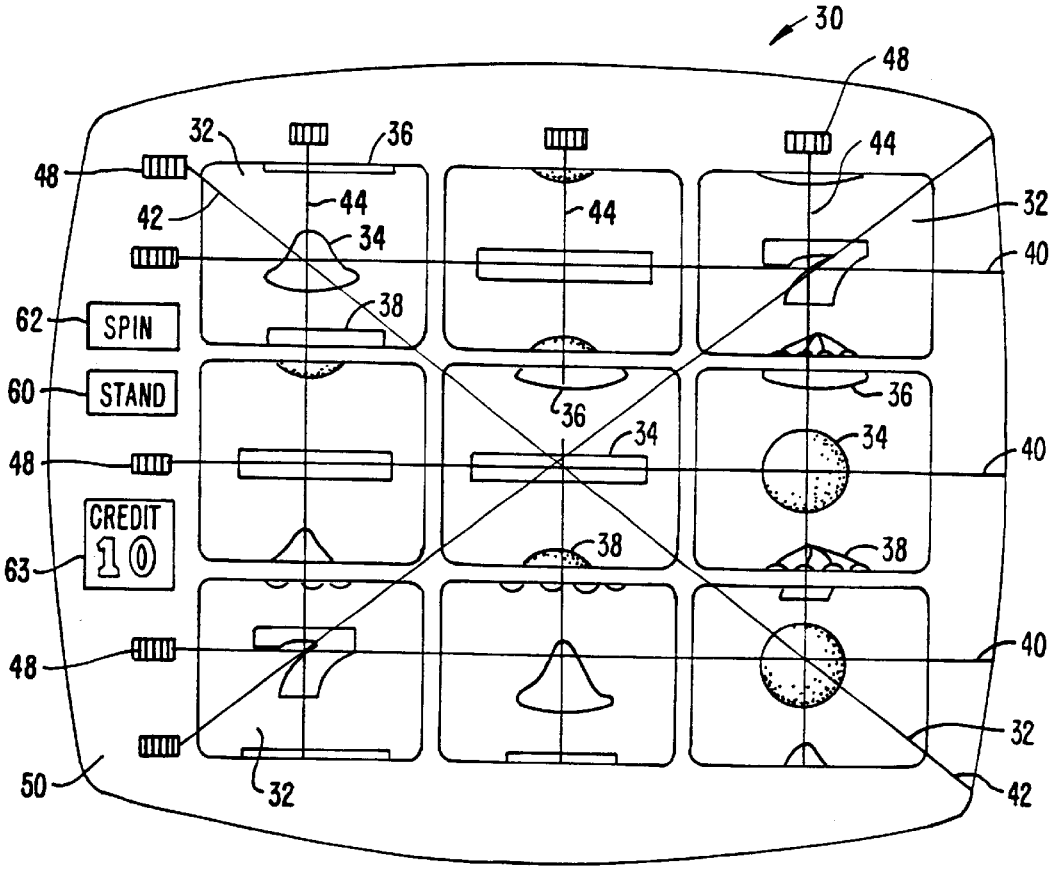
FIG. 2 shows a typical video screen display for the electronic second spin slot machine of FIG. 1.

Turning to FIG. 2, a close up of the video monitor 30 which illustrates game play is shown. In the preferred embodiment, nine symbol display boxes 32 are shown on the video monitor 30 arrayed in three rows and three columns. Each symbol display box 32 preferably shows a full symbol 34 in the center of the display box 32 and partial symbols 36, 38 in the upper and lower peripheries of the display box 32. This combination of full 34 and partial symbols 36, 38 in each display box 32 gives the appearance that each display box is showing a section of an imaginary mechanical reel. In popular slot machine use, these symbols typically take the form of fruit symbols, such as cherries, plums and oranges, as well as non-fruit symbols, such as bars, bells and sevens.

As one alternative embodiment, the partial symbols can be omitted altogether, with only the full symbols 34 being shown. This alternative embodiment would give the appearance that each column of three display boxes shows a section of an imaginary mechanical reel. This would be especially true where the horizontal lines between the symbols in each column, as shown in FIG. 2, are removed so that each column appears to be a continuous mechanical reel. Also, when the symbols in this alternative embodiment are spun, the symbols which are higher in each column should appear to move downward as they would when a mechanical reel is spun. As a second alternative embodiment, the display boxes 32 could be arrayed in different configurations of rows and columns, such as two rows and five columns. As a third alternative, background colors (not shown) could be added to each of the display boxes 32. These background colors could serve as an additional, and possibly independent, basis for creating winning combinations.

Various straight lines 40, 42 and 44 criss-cross the display boxes 32 in horizontal 40, diagonal 42 and vertical 44 directions to illustrate to the player the various combinations of symbols that can be bet. In the preferred embodiment, a betting box 48 is provided at one end of each line where the player can signify which lines are to be bet. In alternative embodiments, the player can not only bet across lines 40, 42 and 44, but can also bet on combinations of all the displayed symbols (e.g., 8 or 9 of a kind) or various other non-linear combinations of symbols (e.g., four corners or criss-crossing symbols).

If a touch screen 50 is used in conjunction with the video monitor 30, these betting boxes 48 can appear to the player to be placed on the video monitor 30 itself. Suitable touch screens 50 for use with the present invention include the TRUEPOINT capacitive sensing screen produced by Micro-Touch Systems, Inc. of Methuen, Mass. and the INTELLI-TOUCH acoustic wave sensing screen produced by ELO TouchSystems of Oak Ridge, Tenn. In the Microtouch touch screen 50, voltage is applied to all four corners of the screen. When the player's finger touches a point on the screen, the player's finger draws current from each side of the screen in proportion to the distance from the edge of the screen. A touch screen controller can then calculate the position of the finger from the current flows. Using such a touch screen 50, the player can simply touch the betting boxes corresponding to the lines he wants to bet before pressing the "spin" button 22 on the button panel 20. Alternatively, if a touch screen 50 is not used, additional buttons can be placed on the button panel 20 and electrically connected to the microprocessor 15 to act as switches which allow the player to signify which lines he wants to bet.

Figure 3:
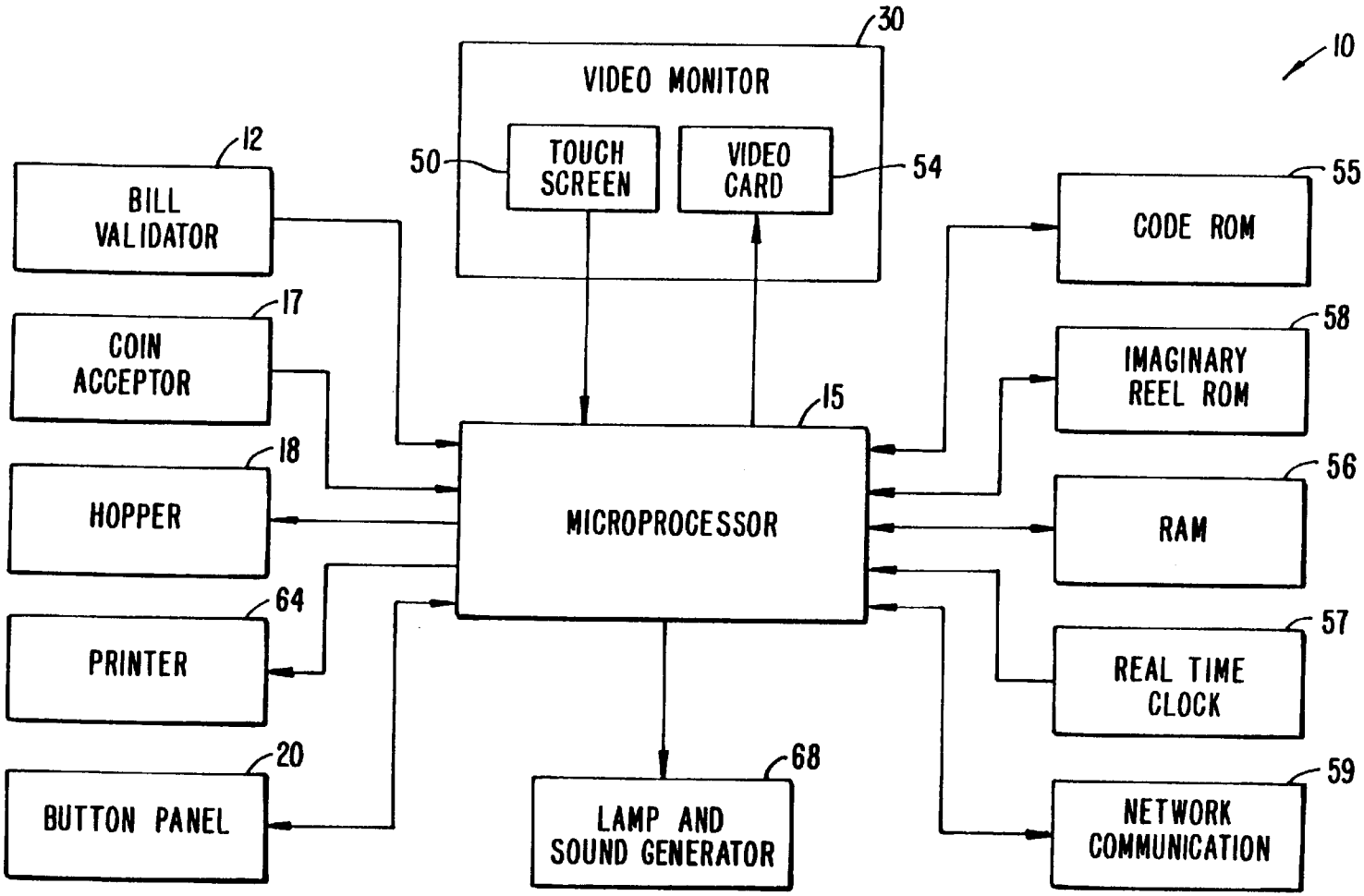
FIG. 3 is a block diagram which schematically shows the control system for the electronic second spin slot machine of FIG. 1.

FIG. 3 is a block diagram which schematically shows the control system for the electronic second spin slot machine 10 of the present invention. At the heart of this control system is the microprocessor 15. Suitable microprocessors include the Z80 microprocessor manufactured by Zilog, Inc. of Campbell, Calif. and the PENTIUM microprocessor manufactured by Intel Corporation of Santa Clara, Calif. The microprocessor 15 relies upon programming instructions stored in code read-only memory (ROM) 55 to execute the game play sequence and appropriate video displays. The code ROM 55 might suitably be a WSIPSD512 chip produced by WaferScale Integration, Inc. of Fremont, Calif.

When game play is initiated by pressing the spin button 22, the microprocessor 15 uses information stored in the video card 54 to simulate a symbol spinning motion in all the display boxes 32. In the preferred embodiment, the video card 54 contains a symbol graphic erasable, programmable read-only memory (EPROM), a static graphics EPROM and a random access memory (RAM). At the same time, the microprocessor 15, in conjunction with a separate RAM 56, generates one or more random numbers which will be used to designate the symbols to be displayed after the first spin. This RAM 56 may suitably take the form of a non-volatile 384K RAM chip. A real time clock 57 may advantageously be used to help the microprocessor 15 generate random numbers by tying the random number generation algorithm to the time of day. This real time clock 57 can also be helpful in generating game histories for storage in RAM 56 or transmission through network communications 59. A suitable real time clock 57 for the present electronic second spin slot machine would be a 2K non-volatile "Dallas Timekeeper" RAM produced by Dallas Semiconductor of Dallas, Tex.

To select the displayed symbols, the microprocessor 15 compares the random numbers generated with a corresponding list of symbols stored in the imaginary reel read-only memory (ROM) 58. The imaginary reel ROM 58 might suitably be a 256K EPROM.

FIG. 4 illustrates how random numbers 1 through 50 might correspond to a group of symbols including sevens, bars, oranges, plums, cherries and bells. For example, if the random number generated by the microprocessor is 24, the corresponding symbol selected from the imaginary reel strip shown in FIG. 4 would be a "plum." To add interest to the game, the imaginary reel strips are typically much longer than 50 numbers and may advantageously have 256 numbers for use with a 256K EPROM.

If background colors are used in the display boxes 32, random numbers could be generated for these colors and compared to reel strips incorporating color designations. The randomly selected colors could then be superimposed behind the symbols in the applicable display box 32. Such randomly generated background colors could be used to create winning combinations either independently or in conjunction with the symbols contained in the display boxes 32.

The number of random numbers and imaginary reel strips which must be used to select a sufficient number of symbols and/or background colors to fill the nine display box arrangement shown in FIG. 2 varies depending upon how the random numbers and reel strips are used. In one preferred embodiment, twelve random numbers and four reel strips are used to determine the combination of symbols displayed in the nine display boxes 32 after the first spin. In this embodiment, one random number and one reel strip are used to determine the full symbols displayed in each column. The reel strip symbol corresponding to the particular random number chosen is displayed as a full symbol in the top box of the column, the next symbol down on the imaginary reel strip is displayed as the full symbol in the middle box and the symbol which is two down is displayed as the full symbol in the lower box. Referring again to the reel strip shown in FIG. 4, if the random number chosen by microprocessor 15 for the left column were an 8, the full symbol in the upper box would be a "bell", the full symbol in the middle box would be a "bar" (9) and the full symbol in the lower box would be a "cherry" (10).

After full symbols are chosen for each of the display boxes 32 in this manner, nine additional random numbers can be generated and compared to a fourth imaginary reel strip to select the partial symbols displayed in each of the nine boxes. For each of the nine random numbers, the reel strip symbol corresponding to the particular random number chosen can be displayed as the partial symbol at the top of the display box 32 and the next reel strip symbol down on the imaginary reel strip can be displayed as the partial symbol at the bottom of the display box 32. Referring once more to the reel strip shown in FIG. 4, if the random number chosen by the microprocessor 15 for a particular display box 32 were a 44, the partial symbol at the top of the box would be an orange and the partial symbol at the bottom of the box would be a bar.

There are, of course, many alternative ways to use random numbers and imaginary reel strips to designate the symbols to be displayed in each display box. For example, a separate imaginary reel strip could be stored in the imaginary reel ROM 58 for each of the display boxes 32; this would mean nine imaginary reel strips for the nine display box preferred embodiment shown in FIG. 2. Separate random numbers could then be generated for each imaginary reel strip and the corresponding reel strip symbol then used for the full symbol displayed in the middle of the display box 32. To avoid generating further random numbers for the partial symbols, the symbols above and below the selected full symbol on the imaginary reel strip could be used as the upper and lower partial symbols. This particular alternative would arguably impart greater randomness to the selection of full symbols because each of the full symbols would be selected from a different reel strip.

As a second alternative, a single imaginary reel strip could be used to select all the full and partial symbols. A separate random number could then be generated to select each full and partial symbol from this single imaginary reel strip. This alternative embodiment would arguably reduce the size of imaginary reel ROM 58 needed but require a larger amount of RAM 56. A third alternative would be to generate only one random number of 72 digits and use each 2 digits of that random number in succession to choose symbols from one or more reel strips.

As a fourth alternative, the imaginary reel strip itself could be varied to randomly choose symbols for display. For example, random numbers could be generated periodically or continuously to "shuffle" or switch the positions of symbols on an imaginary reel strip. More specifically, if random numbers 13 and 6 are generated, the symbols in the "13" and "6" positions on the imaginary reel strip could be switched. For the imaginary reel strip of FIG. 4, this would mean moving a bell symbol from the "13" position to the "6" position and moving a plum symbol from the "6" position to the "13" position. When a symbol is needed for display in a display box 32, the first, last or any particular intermediate symbol on this "shuffled" imaginary reel strip could automatically be chosen by the microprocessor 15. After a symbol is so chosen, the "shuffled" imaginary reel strip could be indexed so that a new symbol would move into the incumbent position to be chosen next.

Once the appropriate full symbols, partial symbols and/or background colors are randomly selected, the microprocessor 15 instructs the video card 54 to stop the spinning symbol simulation and display the selected symbols and/or background colors on the video monitor 30. At the same time, the microprocessor 15 also instructs the video card 54 to light up the stand 60 and respin 62 boxes (FIG. 2) on the video monitor to indicate that the player has an opportunity to respin one or more of the display boxes 32 or stand with the combination displayed after the first spin. In the preferred embodiment, the player is given the opportunity to touch one or more of the display boxes 32, rows of display boxes 32 or columns of display boxes 32 which he wants changed and press the respin box 62 on the video monitor which acts as a switch to initiate the respin. After touching the boxes to be changed, the microprocessor will cause those display boxes 32 to "light up" so that the player can keep track of the boxes he wants respun. A second press of the box by the player can change the designated display box(es) 32 back to a normal shading to indicate that the player no longer wants that box(es) respun. The player can also press the stand box 60 on the video screen to indicate that a respin is not desired. As an alternative way of designating boxes for respin, the player might simply touch the selected display box 32, row of display boxes 32 or column of display boxes 32 and automatically begin the respin process, without the need to touch an additional "respin" box 62.

Where background colors are used in the display boxes 32, the player might be given the option of respinning symbols in the display box, respinning background colors in the display box or both. A switch could be provided either on the touchscreen 50 or console (not shown) to allow the player to designate whether he is choosing symbols, background colors or both for respin. When this switch is used, the illumination of either the symbols or the background colors in the display boxes could increase in order to confirm to the player whether he is designating symbols or colors for respin.

When the respin box 62 is pressed by the player after an appropriate designation of display boxes 32 to be respun, the microprocessor 15 and video card 54 will again simulate spinning symbols in those boxes and only those boxes. By contrast, the non-designated boxes will continue to display their first spin results in stationary form. While spinning is being simulated in the boxes selected for respin, the microprocessor 15 will again be producing random numbers and using those random numbers to select new symbols to be displayed from the imaginary reel ROM 58. In the preferred embodiment, a single imaginary reel strip is dedicated to the selection of respun symbols. The imaginary reel strip symbol corresponding to the selected random number is displayed as the full symbol in the respin display box 32, with the imaginary reel strip symbols above and below the selected full symbol on the imaginary reel strip being shown as partial symbols in that display box 32. _Of course, the same sort of alternatives for selecting the displayed symbols for the first spin can also be used in selecting displayed symbols for respin. Since a full imaginary reel strip is used in this embodiment to select replacement symbols, it is possible, unlike video poker, to randomly select replacement symbols which are the same as the initially displayed symbols that the player wants to replace.

After the respin full and partial symbols are selected by the microprocessor 15, the microprocessor instructs the video card 54 to stop the spinning symbol simulation and display the selected symbols in the appropriate respin boxes. At this point, the microprocessor can determine whether the game is a winner or loser by comparing the combination of full symbols displayed on the video screen with the betting lines 40, 42, 44 the player has selected and the combination of winning symbols stored in a read-only memory, such as the code ROM 55. If the microprocessor 15 determines that there is a winning combination on one or more of the lines 40, 42, 44 that the player has bet, the microprocessor 15 then refers to a payout table stored in an appropriate read-only memory, such as the code ROM 55, to determine the amount the player has won. The combination of winning symbols and their respective payouts should also be displayed in written form 60 on the face of the slot machine 10 to allow the player to confirm the determinations made by the microprocessor 15.

If the game is a winning game, the amount of the player's winnings will be noted as a credit 63 on the video monitor 30. If the player desires, he can press the cash out 26 button on the button panel 20 to redeem this credit. In the preferred embodiment, the redemption takes the form of a printed sheet issued by printer 64 (FIGS. 1 and 3) and provided to the player through payout tray 66. Where the second spin slot machine uses coins, the microprocessor 15 can activate coin hopper 18 to count out an appropriate number of coins and return them to the player through payout tray 66. To add excitement and interest to the game, the microprocessor 15 can activate lights 68 and a sound generator (FIGS. 1 and 3) to announce that the player has won the game.

Figure 5:
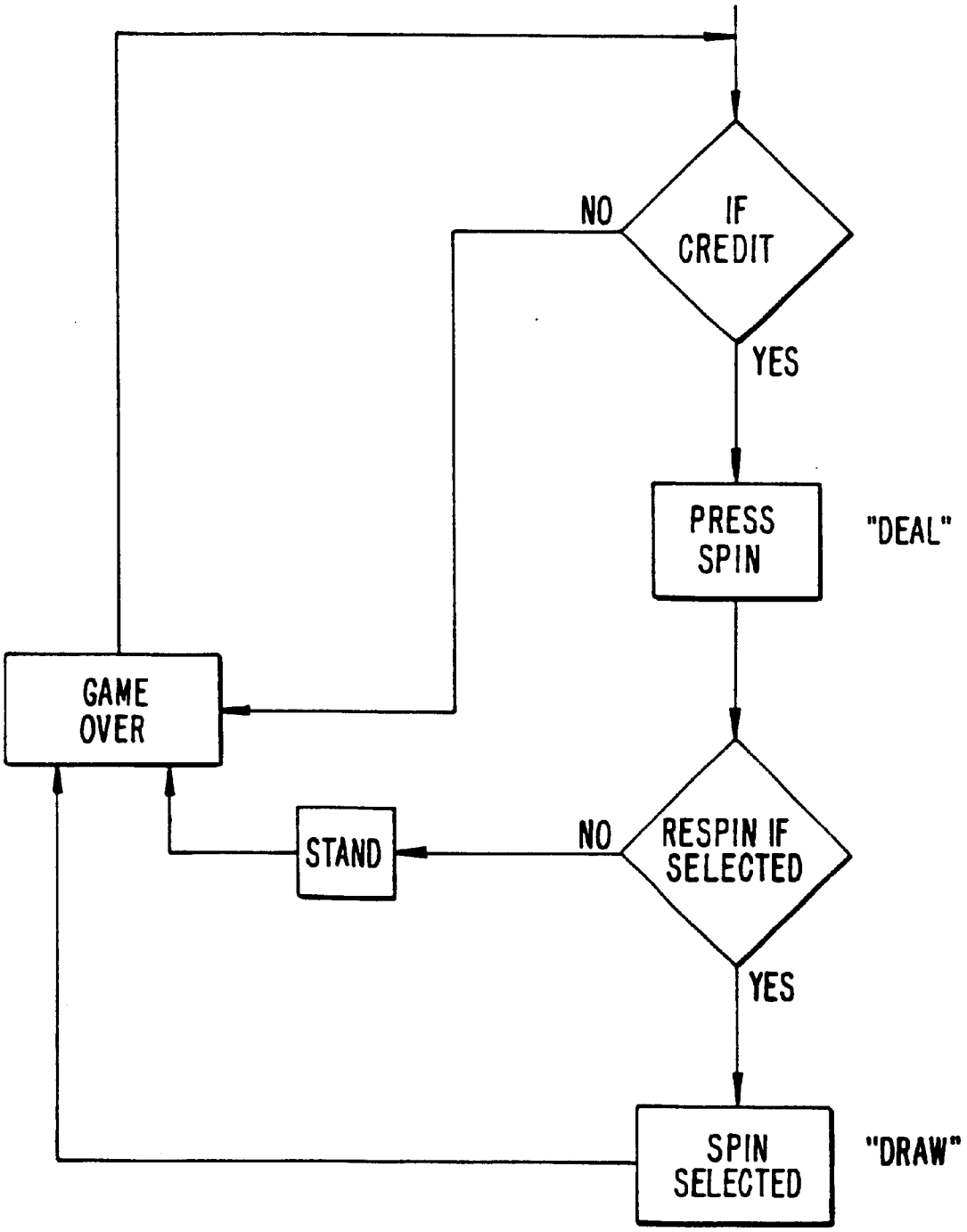
FIG. 5 is a flow chart for the sequence of play in the preferred form of electronic slot machine.

After the game has been completed, the microprocessor 15 stores the results of the game in RAM 56 for later analysis and resets for initiation of a new game. The applicable sequence of play is summed up in flow chart form in FIG. 5.

To allow predictability of payout for the slot machine owner, the number of display boxes that can be respun each game is preferably limited to one. This limiting of respin boxes also can increase the amount of skill that must be applied by the player to select the best box for respin. Unlike games such as video poker, the electronic second spin slot machine of the present invention adds additional challenges to the player using multiple betting lines 40, 42, 44 by requiring that player to think in multiple dimensions. For example, choosing a respin of the center display box 32 can simultaneously affect combinations along two diagonal lines, one horizonal line and one vertical line. Similarly, choosing a respin of a corner display box 32 can simultaneously affect combinations along a diagonal, a horizontal and a vertical line. Additional complication and skill can be added to the slot machine game of the present invention by allowing players to bet additional lines after the first spin has taken place but before boxes are designated for respin.

While limiting the respin to one box is the preferred embodiment, there are many respin variations which would nonetheless be within the scope of the present invention. For example, the preferred embodiment described thus far allows only one round of respinning symbols. If desired, multiple rounds of choosing symbols for respin could also be allowed. With such multiple rounds, the player could view the results of the first respin round and choose additional display boxes to be respun in a second round. Further interest could be added to this multiple round respin by requiring the player to fund and redesignate betting lines 40, 42, 44 before each respin round. With multiple respin rounds and renewed betting before each respin round, a game could conceivably be continued indefinitely.

A more limited form of multiple round respin could occur only if the respun symbol turns out to be the same as the original symbol that the player was trying to replace. This frustrating scenario could be turned to the player's advantage in any number of ways. For example, the respun symbol could be automatically, or at the player's option, respun one more time or continually respun until a different symbol appears. Alternatively, if confronted with the same symbol reappearing, the player could be given the option of respinning the symbols in different boxes or be given the option of respinning all of the symbols which are identical to the continually reappearing symbol.

Additionally, the electronic second spin slot machine apparatus of the present invention could be used for games which do not require a second spin. For example, in the touch screen embodiment of the present invention, the player could be given the opportunity to touch two different symbols from the first spin display and switch their position. Alternatively, a tenth randomly generated symbol could be added to the display shown in FIG. 2 and the player given the opportunity to substitute this tenth symbol for one of the other nine symbols.

In the foregoing specification, the invention has been described with reference to specific preferred embodiments and methods. It will, however, be evident to those of skill in the art that various modifications and changes may be made without departing from the broader spirit and scope of the invention as set forth in the appended claims. Further examples of such modifications include allowing the player to designate which symbols to keep rather than designate which symbols to respin. In this embodiment, all the symbols which are not chosen will be respun. As an additional modification, the originally displayed symbols could be preselected, as in a pull-tab game, rather than being the result of a random number generator. In a further modification of the embodiment where the player can choose only one box for respin, the apparatus of the present invention could also respin all other boxes which have the same full symbol as the one box chosen for respin. In this embodiment, for example, if the player chooses a box for respin with a plum symbol, all other boxes with a plum symbol would simultaneously be respun. The specification and drawings are, accordingly, to be regarded in an illustrative, rather than restrictive, sense; the invention being limited only by the appended claims.

What is claimed is:

1. A method of operating an electronic gaming apparatus having a plurality of symbols arrayed in separate boxes of multiple symbol columns and rows on a touch screen monitor comprising the steps of:

selecting initial symbols to be arrayed in said separate boxes of said multiple symbol columns and rows on said touch screen monitor;

displaying the initial symbols selected in an array of separate boxes of multiple symbol columns and rows on said monitor;

allowing the player to designate a chosen number, from none to all, of said initial displayed symbols for replacement by touching appropriate symbols, boxes and/or instructions on said touch screen;

selecting said chosen number of replacement symbols;

replacing said chosen number of initial symbols on said monitor with replacement symbols;

determining whether said replacement symbols and any remaining initial symbols arrayed in said separate boxes of said multiple symbol columns and rows constitute a winning combination; and, rewarding a winning combination.

2. The method of claim 1 wherein game play is only commenced if it is determined that an appropriate amount of money has been inserted into the gaming apparatus.

3. The method of claim 1 wherein said symbols are randomly selected by a microprocessor.

4. The method of claim 1 wherein symbols are designated for replacement and replaced on multiple occasions before it is determined whether a winning combination exists.

5. The method of claim 1 wherein the option is provided of designating no symbols for replacement.

6. The method of claim 1 wherein only one symbol can be designated for replacement.

7. The method of claim 1 wherein multiple symbols can be designated for replacement.

8. The method of claim 1 wherein a list of winning combinations is stored in a memory and compared to the combination displayed on said monitor to determine if there is a winning combination.

9. The method of claim 1 wherein said touch screen box lights up when the player designates its symbol for replacement.

10. The method of claim 5 wherein the player can touch an instruction on said touch screen to indicate that none of the initial symbols should be replaced.

11. The method of claim 1 wherein, after the player has designated the chosen number of symbols to be replaced, the player touches an instruction to actuate replacement of the chosen number of symbols.

12. The method of claim 9 wherein the player can undesignated a symbol for replacement by touching that designated symbol or its box a second time.

13. The method of claim 1 wherein each said replacement symbol is selected from a group which includes the initial symbol it replaces.

14. The method of claim 11 wherein said instruction to actuate replacement is located said touch screen.

15. The method of claim 1 wherein a symbol is immediately replaced as soon as the player touches said symbol or its box on said touch screen.

16. The method of claim 11 wherein said instruction to actuate replacement is located on a button residing outside said touch screen.

17. A method of operating an electronic gaming apparatus having a plurality of symbols and background colors arrayed in separate boxes of multiple columns and rows on a touch screen monitor comprising the steps of:

selecting initial symbols and initial background colors for said symbols to be so arrayed in said separate boxes of said multiple columns and rows on said touch screen monitor;

allowing the player to designate a chosen number, from none to all, of said initial symbols and initial background colors for replacement by touching appropriate symbols, boxes and/or instructions on said touch screen;

selecting said chosen number of replacement symbols and background colors;

replacing said chosen number of initial symbols and initial background colors on said monitor with replacement symbols and replacement background colors; and, determining whether said replacement symbols and replacement background colors, together with any remaining initial symbols and initial background colors arrayed in said separate boxes of said multiple columns and rows, constitute a winning combination; and, rewarding a winning combination.

18. The method of claim 17 wherein said replacement background colors are chosen independently of said replacement symbols.

19. An electronic gaming apparatus comprising:

a touch screen monitor for displaying a plurality of symbols arrayed in separate boxes of multiple symbol columns and rows;

a memory which stores a list of possible symbols to be displayed on said monitor;

a microprocessor to select symbols from said memory for display on said monitor and to determine whether a final group of displayed symbols creates a winning or losing game;

a first switch to initiate game play by causing the microprocessor to select an initial set of symbols and display those initial symbols arrayed in separate boxes of multiple symbol columns and rows on said monitor; and, a second switch to complete game play by allowing the player to choose for replacement from none to all of said initial symbols by touching appropriate symbols, boxes and/or instructions on said touch screen and have said microprocessor randomly select said replacement symbols from a list of possible symbols in said memory and then display on said monitor said replacement symbols together with any remaining initial symbols to create said final group of displayed symbols arrayed in separate boxes of multiple symbol columns and rows.

20. The electronic gaming apparatus of claim 19 wherein said player chooses initial symbols for replacement by designating which initial symbols to replace.

21. The electronic gaming apparatus of claim 19 wherein said player chooses initial symbols for replacement by designating which initial symbols should be kept and then allowing said electronic gaming apparatus to replace all non-designated symbols.

22. The electronic gaming apparatus of claim 19 wherein said player can designate one or more columns of initial symbols for replacement.

23. The electronic gaming apparatus of claim 22 wherein said columns of initial symbols have the appearance of reels on a mechanical reel type of slot machine.

24. The electronic gaming apparatus of claim 19 wherein said player can designate one or more rows of initial symbols for replacement.

25. The electronic gaming apparatus of claim 19 wherein nine symbols are arrayed in three rows and three columns.

26. The electronic gaming apparatus of claim 19 wherein said touch screen box lights up when the player designates its symbol for replacement.

27. The electronic gaming apparatus of claim 26 wherein the player can touch an instruction on said touch screen to indicate that none of the initial symbols should be replaced.

28. The electronic gaming apparatus of claim 19 wherein only one symbol can be chosen for replacement.

29. The electronic gaming apparatus of claim 19 wherein multiple symbols can be chosen for replacement.

30. A method of operating an electronic gaming apparatus having a plurality of symbols arrayed in multiple symbol columns and rows on its monitor comprising the steps of:

selecting initial symbols to be arrayed in said multiple symbol columns and rows;

displaying the initial symbols selected in an array of multiple symbol columns and rows on said monitor;

allowing the player to designate a chosen number, from one to all, of said initial displayed symbols for replacement;

selecting said chosen number of replacement symbols;

replacing said chosen number of initial symbols on said monitor with replacement symbols;

determining whether said replacement symbols and any remaining initial symbols arrayed in said multiple symbol columns and rows constitute a winning combination by assessing whether particular symbols are aligned horizontally, vertically, diagonally or in another geometric pattern which matches a predetermined winning combination; and, rewarding a winning combination.

31. An electronic gaming apparatus comprising:

a touch screen monitor for displaying a plurality of symbols arrayed in multiple symbol columns and rows;

a memory which stores a list of possible symbols to be displayed on said monitor;

a microprocessor to select symbols from said memory for display on said monitor and to determine whether a final group of displayed symbols creates a winning or losing game by assessing whether particular symbols are aligned horizontally, vertically, diagonally or in another geometric pattern which matches a predetermined winning combination;

a first switch to initiate game play by causing the microprocessor to select an initial set of symbols and display those initial symbols arrayed in multiple symbol columns and rows on said monitor; and, a second switch to complete game play by allowing the player to choose for replacement from none to all of said initial symbols by touching appropriate symbols, boxes and/or instructions on said touch screen monitor and have said microprocessor randomly select said replacement symbols from a list of possible symbols in said memory and then display on said monitor said replacement symbols together with any remaining initial symbols to create said final group of displayed symbols arrayed in multiple symbol columns and rows.

32. A method of operating an electronic gaming apparatus having a plurality of symbols arrayed in multiple symbol columns and rows on its monitor comprising the steps of:

selecting initial symbols to be arrayed in said multiple symbol columns and rows;

displaying the initial symbols selected in an array of multiple symbol columns and rows on said monitor after a display of a simulated spinning motion;

designating a chosen number, from one to all, of said initial displayed symbols for replacement;

selecting said chosen number of replacement symbols;

replacing said chosen number of initial symbols on said monitor with replacement symbols after the display of a simulated spinning motion;

determining whether said replacement symbols and any remaining initial symbols arrayed in said multiple symbol columns and rows constitute a winning combination; and, rewarding a winning combination.

33. An electronic gaming apparatus comprising:

a touch screen monitor for displaying a plurality of symbols arrayed in multiple symbol columns and rows;

a memory which stores a list of possible symbols to be displayed on said monitor;

a microprocessor to select symbols from said memory for display on said monitor and to determine whether a final group of displayed symbols creates a winning or losing game;

a first switch to initiate game play by causing the microprocessor to select an initial set of symbols and, after using a simulated spinning motion, display those initial symbols arrayed in multiple symbol columns and rows on said monitor; and, a second switch to complete game play by allowing the player to choose for replacement from none to all of said initial symbols by touching appropriate symbols, boxes and/or instructions on said touch screen and have said microprocessor randomly select said replacement symbols from a list of possible symbols in said memory and then display on said monitor, after using a simulated spinning motion, said replacement symbols together with any remaining initial symbols to create said final group of displayed symbols arrayed in multiple symbol columns and rows.

34. A method of operating an electronic gaming apparatus having a plurality of symbols arrayed in multiple symbol columns and rows on its monitor so as to appear to be on a plurality of vertical reels comprising the steps of:

selecting initial symbols to be arrayed in said multiple symbol columns and rows;

displaying the initial symbols selected in an array of multiple symbol columns and rows on said monitor so as to appear to be on a plurality of vertical reels;

designating a chosen number, from one to all, of said initial displayed symbols for replacement;

selecting said chosen number of replacement symbols;

replacing said chosen number of initial symbols on said monitor with replacement symbols;

determining whether said replacement symbols and any remaining initial symbols arrayed in said multiple symbol columns and rows constitute a winning combination; and, rewarding a winning combination.

35. An electronic gaming apparatus comprising:

a touch screen monitor for displaying a plurality of symbols arrayed in multiple symbol columns and rows so as to appear to be on a plurality of vertical reels;

a memory which stores a list of possible symbols to be displayed on said monitor;

a microprocessor to select symbols from said memory for display on said monitor and to determine whether a final group of displayed symbols creates a winning or losing game;

a first switch to initiate game play by causing the microprocessor to select an initial set of symbols and display those initial symbols arrayed in multiple symbol columns and rows on said monitor; and, a second switch to complete game play by allowing the player to choose for replacement from none to all of said initial symbols by touching appropriate symbols, boxes and/or instructions on said touch screen and have said microprocessor randomly select said replacement symbols from a list of possible symbols in said memory and then display on said monitor said replacement symbols together with any remaining initial symbols to create said final group of displayed symbols arrayed in multiple symbol columns and rows.

* * * * *

US006641477C1

(12) EX PARTE REEXAMINATION CERTIFICATE (10486th)

United States Patent

Dietz, II

(10) Number: US 6,641,477 C1

(45) Certificate Issued: *Jan. 29, 2015

(54) ELECTRONIC SECOND SPIN SLOT MACHINE

(75) Inventor: Michael J. Dietz, II, Peralta, NM (US)

(73) Assignee: Rembrandt Gaming Technologies, LP, Arlington, VA (US)

Reexamination Request:
No. 90/012,379, Jun. 29, 2012

Reexamination Certificate for:

| | |
|---|---|
| Patent No.: | **6,641,477** |
| Issued: | **Nov. 4, 2003** |
| Appl. No.: | **09/003,003** |
| Filed: | **Jan. 5, 1998** |

( * ) Notice: This patent is subject to a terminal disclaimer.

Related U.S. Application Data

(63) Continuation-in-part of application No. 08/571,743, filed on Dec. 13, 1995, now Pat. No. 5,704,835.

(51) Int. Cl.
*G07F 17/34* (2006.01)
*G07F 17/32* (2006.01)

(52) U.S. Cl.
CPC ..... *G07F 17/3265* (2013.01)
USPC ..... 463/20; 463/16; 273/143 R

(58) Field of Classification Search
None
See application file for complete search history.

(56) References Cited

To view the complete listing of prior art documents cited during the proceeding for Reexamination Control Number 90/012,379, please refer to the USPTO's public Patent Application Information Retrieval (PAIR) system under the Display References tab.

*Primary Examiner* — Albert J Gagliardi

(57) ABSTRACT

An electronic slot machine (10) and method of use which allows a player to completely replace up to all of the initial symbols displayed after the first draw in order to create, improve or even lose a winning combination. In its preferred form, the electronic slot machine of the present invention features a video monitor (10) with a plurality of separate symbol display boxes (32) arrayed in rows and columns. When the machine is activated, one or more random numbers are generated in the slot machine's microprocessor (15) to determine which symbols are to be displayed in each of the symbol display boxes. If a suitable winning combination is not formed with the initial symbols, the player is given opportunities to select up to all of the symbol display boxes for replacement.

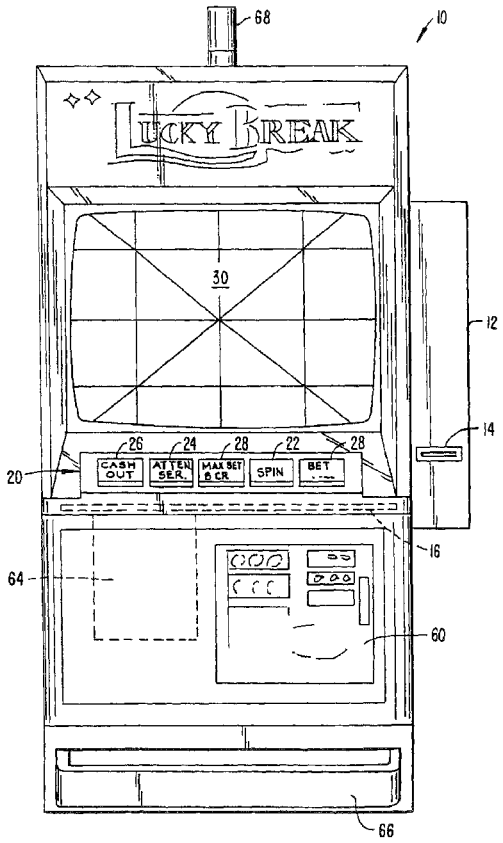

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

The patentability of claim 32 is confirmed.

Claims 1 and 34 are cancelled.

Claims 2-31, 33 and 35 were not reexamined.

* * * * *